US008549809B2

(12) United States Patent
Golden et al.

(10) Patent No.: US 8,549,809 B2
(45) Date of Patent: Oct. 8, 2013

(54) VIBRATION ISOLATION MOUNTING CLIP

(75) Inventors: Matthew V. Golden, Columbus, OH (US); Gregory A. Hively, Grove City, OH (US); Paul W. Meisel, Dublin, OH (US); Richard S. Sherren, Pataskala, OH (US); Matthew S. Swysgood, Sunbury, OH (US)

(73) Assignee: Kinetics Noise Control, Inc., Dublin, OH (US)

( * ) Notice: Subject to any disclaimer, the term of this patent is extended or adjusted under 35 U.S.C. 154(b) by 813 days.

(21) Appl. No.: 12/419,293

(22) Filed: Apr. 7, 2009

(65) Prior Publication Data

US 2010/0251652 A1 Oct. 7, 2010

(51) Int. Cl.
*E04B 9/00* (2006.01)

(52) U.S. Cl.
USPC ..... 52/506.06; 52/167.1; 52/506.05; 52/702

(58) Field of Classification Search
USPC ..... 52/167.1, 506.05, 506.06, 489.1, 551, 52/605, 702, 712
See application file for complete search history.

(56) References Cited

U.S. PATENT DOCUMENTS

| | | | | | |
|---|---|---|---|---|---|
| 1,745,171 | A | | 11/1928 | Kocher | |
| RE18,573 | E | * | 8/1932 | Kocher | 52/402 |
| 3,067,323 | A | * | 12/1962 | Kember | 362/150 |
| 4,747,249 | A | * | 5/1988 | Bell et al. | 52/543 |
| 4,879,856 | A | * | 11/1989 | Jones et al. | 52/403.1 |
| 6,115,981 | A | * | 9/2000 | Counihan | 52/403.1 |
| 7,576,993 | B2 | * | 8/2009 | Hsieh et al. | 361/753 |
| 7,665,253 | B1 | * | 2/2010 | Thompson | 52/167.1 |
| 2007/0261348 | A1 | | 11/2007 | Surowiecki | |

FOREIGN PATENT DOCUMENTS

| | | | | |
|---|---|---|---|---|
| AU | 08201668 | A | | 4/2007 |
| GB | 1084776 | A | | 9/1967 |
| JP | 2007046410 | A | | 2/2007 |
| WO | WO 00/63506 | A | | 10/2000 |
| WO | WO2005/031080 | A | | 4/2005 |
| WO | WO 2005031080 | | * | 4/2005 |
| WO | WO 2008/009116 | A | | 1/2008 |

* cited by examiner

*Primary Examiner* — Brian Glessner
*Assistant Examiner* — Adam Barlow
(74) *Attorney, Agent, or Firm* — Kathleen K. Bowen

(57) ABSTRACT

A vibration isolating mounting clip which is used to mount a furring channel to a mounting surface, which is then further loaded with a finishing substrate via the furring channel consists of a resilient bent metal strip. The resilient bent metal strip has a first end and an opposing second end, and a transition portion shaped to fit the furring channel. Through different aspects of the invention either the first end, or the first and second end is mounted to the mounting surface. The resilient bent metal strip has a stiffness and shape such that when the furring channel is positioned in the resilient bent metal strip, and the resilient bent metal strip is mounted to the mounting surface, and a finishing substrate is loaded on the furring channel, the furring channel does not contact the mounting surface. Between the ends of the resilient bent metal strip, and the furring channel, are one to several bends, towards and away from the mounting surface to achieve the desired resiliency.

7 Claims, 7 Drawing Sheets

VIBRATION ISOLATION MOUNTING CLIP

This application claims the benefit of U.S. Provisional Application No. 61/041,919 filed, Apr. 3, 2008.

BACKGROUND

The present invention is in the field of noise and vibration control. More specifically this invention relates to an apparatus for isolating the structure borne vibration, and therefore the noise transferred from one part of a building to another.

In many building applications, furring channels are used to attach one part of a building structure, for example wallboard or other sheet material, to another part of the building structure. Noise, transmitted structurally as vibration, is often transmitted from one part of the building to another through the furring channel connection points.

When hanging a ceiling from a structure, furring channels are often attached to the joists, and the ceiling panels are then hung from the furring channels. In order to reduce the noise and vibration transferred via these connections, there are vibration isolating mounting methods. One of these methods is using a resilient channel. This is a metal channel with at least one flange, which is attached to the mounting surface via this flange, and wherein the remainder of the channel is offset from the mounting surface, thereby, when the wallboard or ceiling structure is mounted to the channel portion, it is isolated from the mounting surface. There are many opportunities for the resilient channel to fail by "shorting-out". If the deflection of the channel is not enough, the channel may come in contact with the stud. Also, mounting of the drywall or other material to the channel is often done where the mounting mechanism passes through the drywall, and inadvertently goes through too far, and comes in contact with the mounting surface. Further, the resilient channels are not used in conjunction with standard furring channels, but are specifically ordered for the application. Mounting clips are available for mounting standard furring channels to a mounting surface, such that the drywall/ceiling is vibrationally isolated from the mounting surface. These clips can be expensive to manufacture. Prior art clips, in some cases only provide minimal deflection.

A mounting apparatus is needed for mounting standard furring channels to a mounting surface, such that drywall/ceiling mounted to these furring channels will be vibrationally isolated from the mounting surface. Further, a vibration isolating mounting apparatus is need for mounting other substrate to a mounting surface, such as mounting a ceiling grid for a floating ceiling to the mounting surface.

SUMMARY

A vibration isolating mounting clip which is used to mount a furring channel to a mounting surface, which is then further loaded with a finishing substrate via the furring channel consists of a resilient bent metal strip. The resilient bent metal strip has a first end and an opposing second end, and a transition portion shaped to fit the furring channel. Through different aspects of the invention either the first end, or the first and second end is mounted to the mounting surface. The resilient bent metal strip has a stiffness and shape such that when the furring channel is positioned in the resilient bent metal strip, and the resilient bent metal strip is mounted to the mounting surface, and a finishing substrate is loaded on the furring channel, the furring channel does not contact the mounting surface. Between the ends of the resilient bent metal strip, and the furring channel, are one to several bends, towards and away from the mounting surface to achieve the desired resiliency.

DETAILED DESCRIPTION

Figure 1:
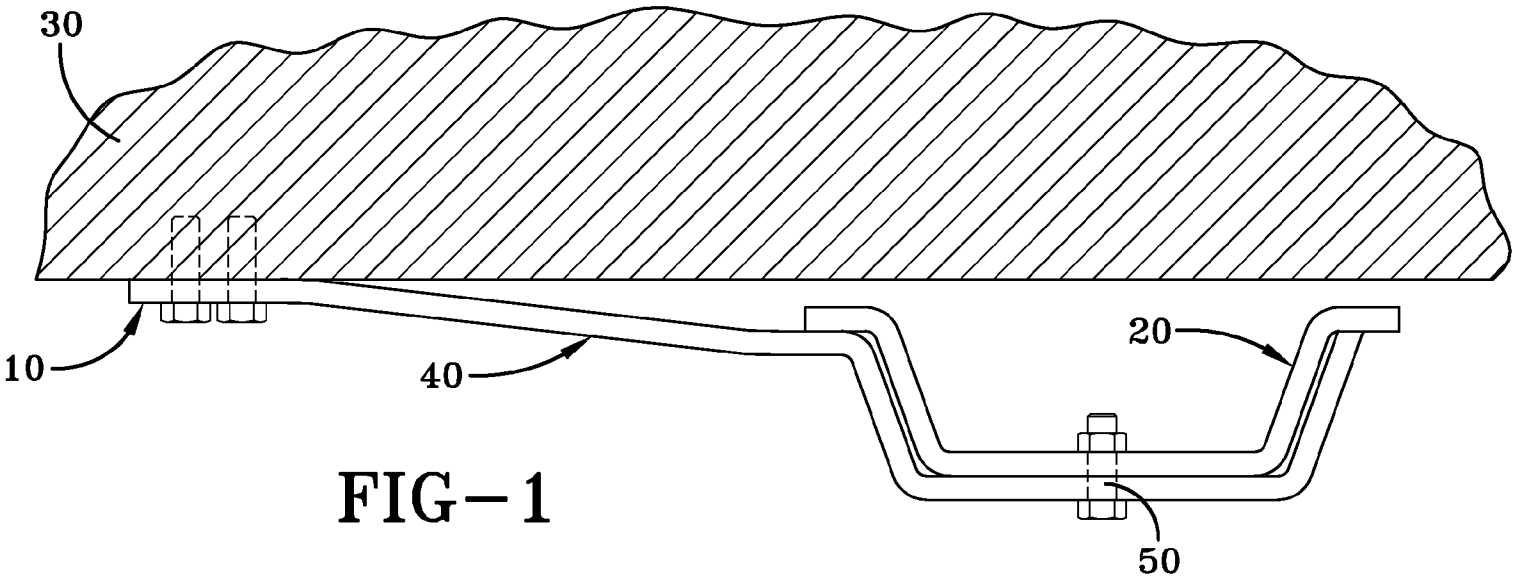
FIG. 1 is a side view of a vibration isolating mounting clip mounted to a mounting surface according to an aspect of the invention.
Figure 2:
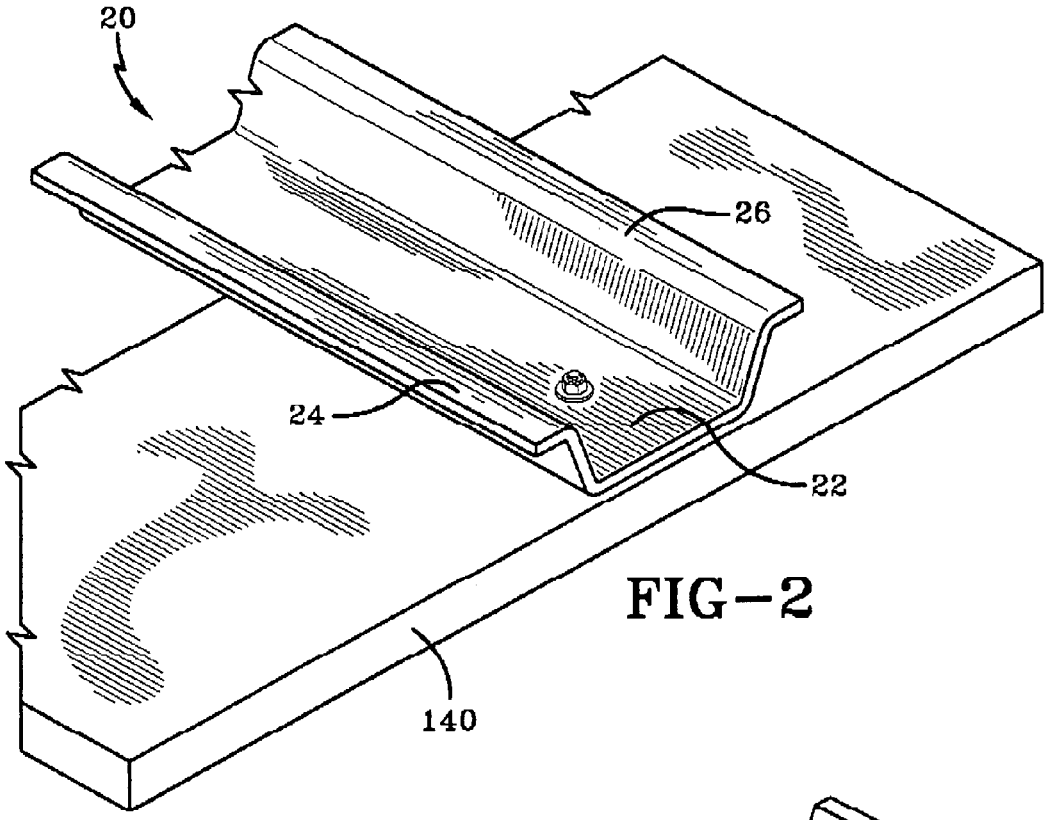
FIG. 2 is an isometric view of a furring channel.
Figure 3:
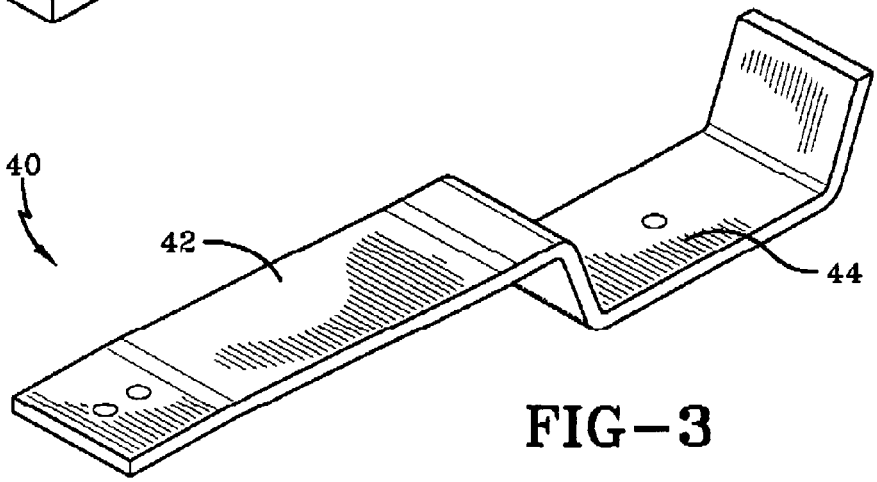
FIG. 3 is an isometric view of a vibration isolating mounting clip according to an aspect of the invention.
Figure 5:
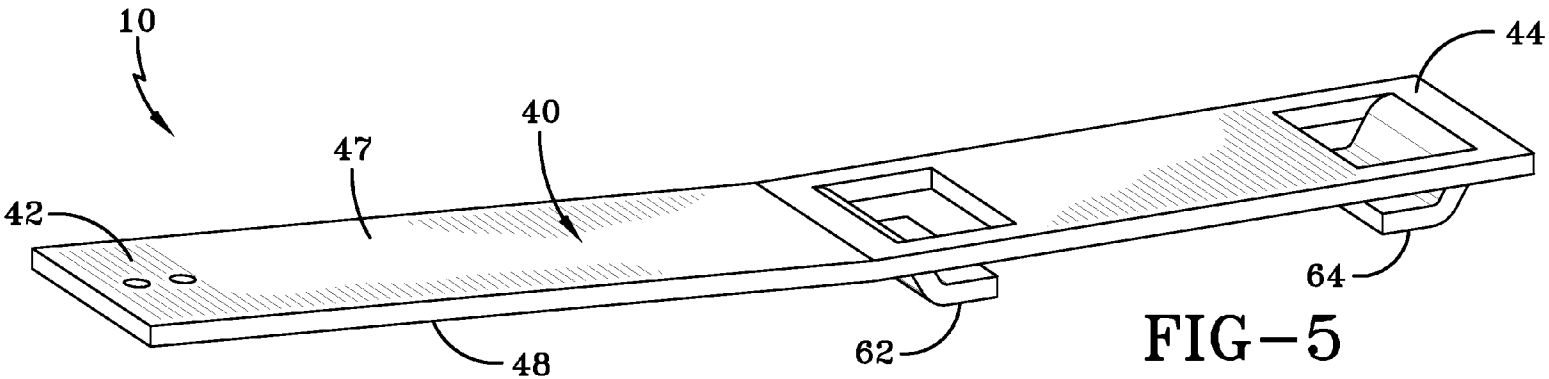
FIG. 5 is an isometric view of a vibration isolating mounting clip according to an aspect of the invention.
Figure 4:
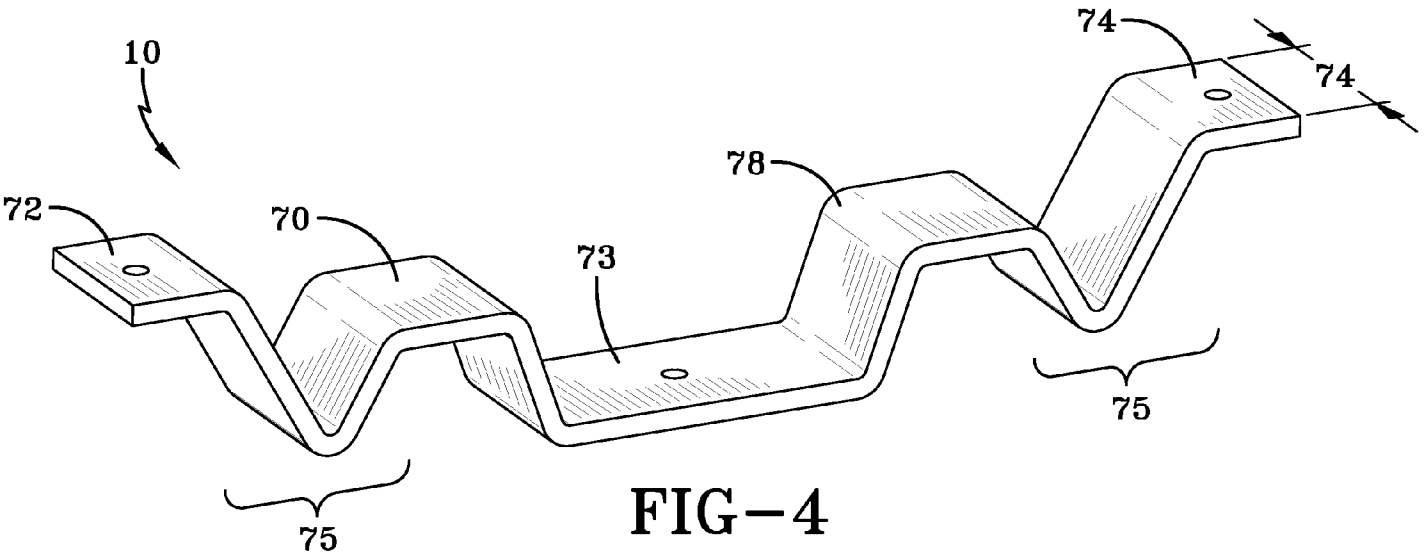
FIG. 4 is an isometric view of a vibration isolating mounting clip according to an aspect of the invention.
Figure 6:
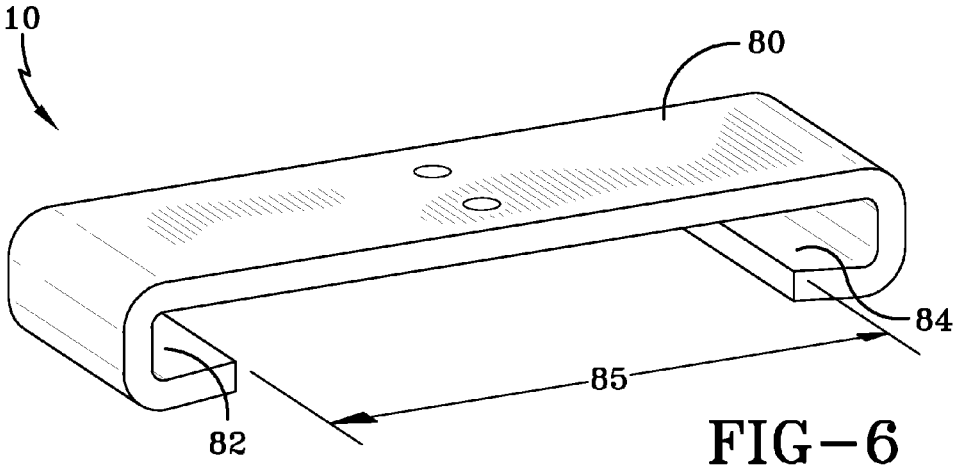
FIG. 6 is an isometric view of a vibration isolating mounting clip according to an aspect of the invention.
Figure 7:
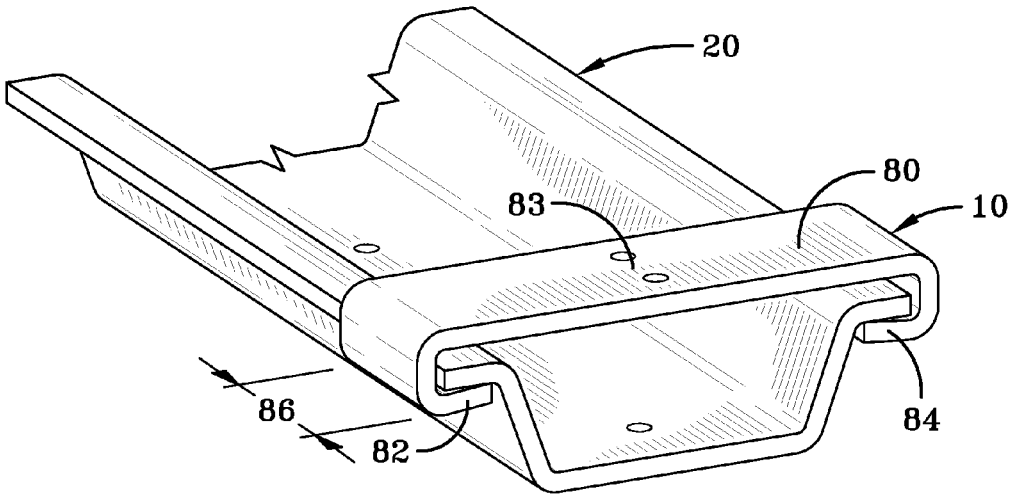
FIG. 7 is an isometric view of a vibration isolating mounting clip holding a furring channel according to an aspect of the invention.
Figure 8:
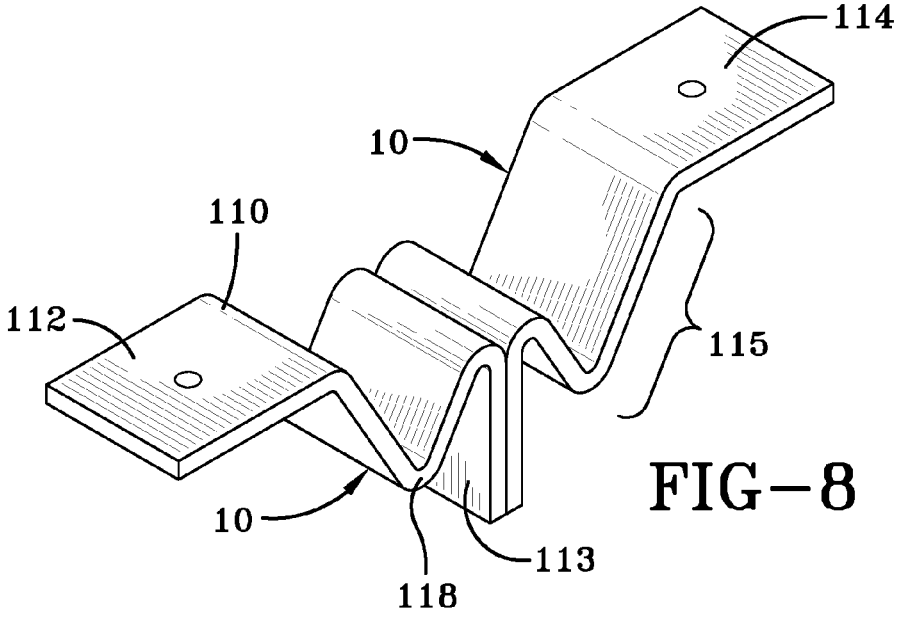
FIG. 8 is an isometric view of a vibration isolating mounting clip according to an aspect of the invention.
Figure 9:
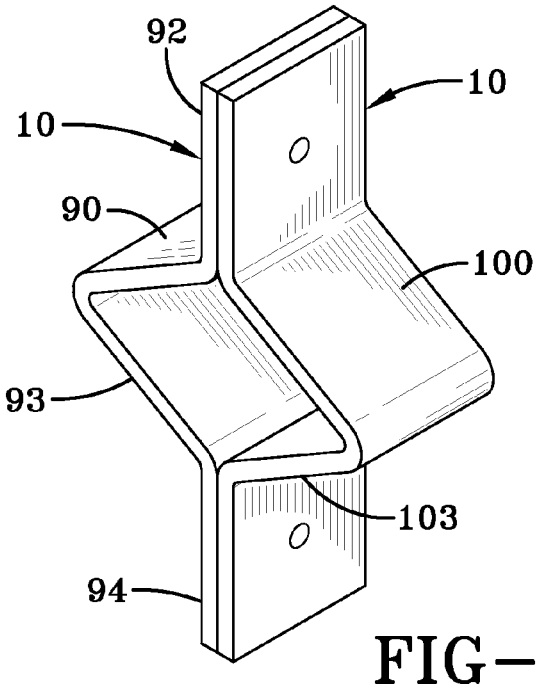
FIG. 9 is an isometric view of a vibration isolating mounting clip according to an aspect of the invention.
Figure 10A:
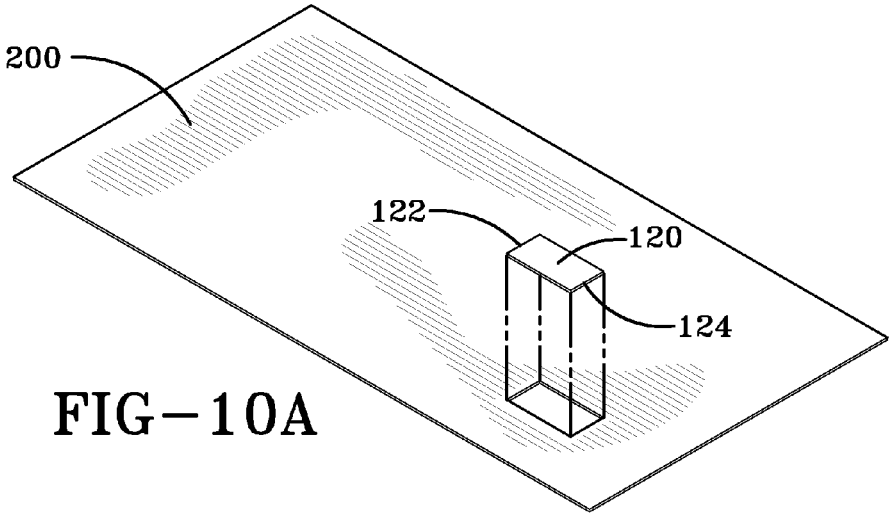
FIG. 10A is an isometric view of a sheet of material according to an aspect of the invention.
Figure 10B:
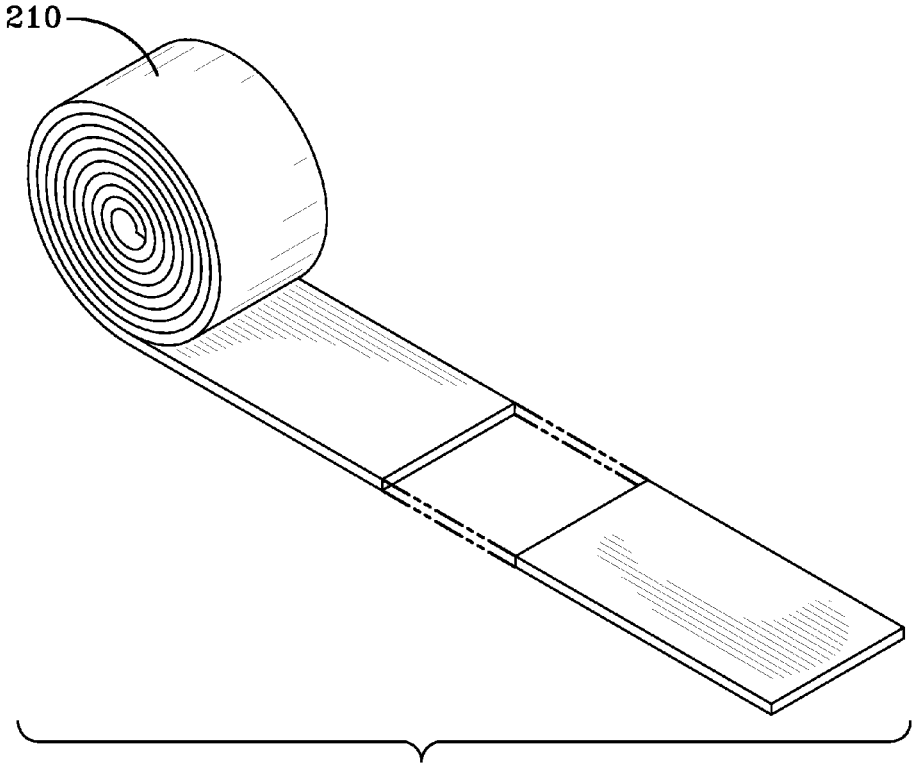
FIG. 10*b* is an isometric view of a roll of material according to an aspect of the invention.
Figure 11A:
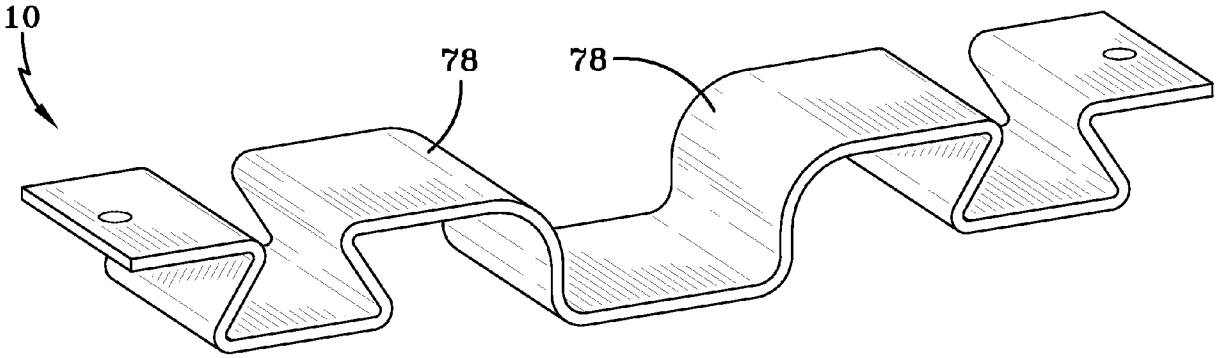
FIG. 11A is an isometric view of a vibration isolating mounting clip according to an aspect of the invention.
Figure 11B:
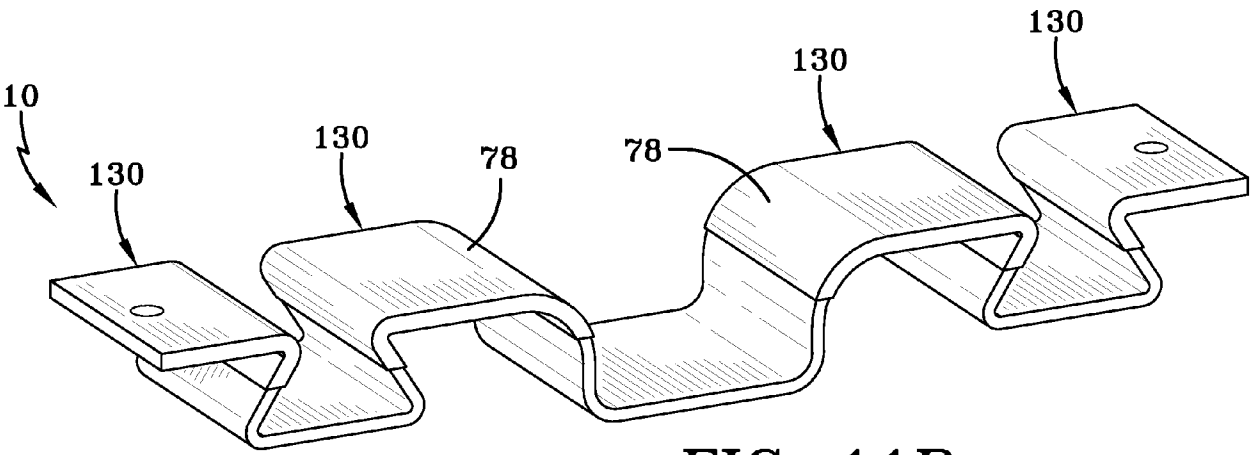
FIG. 11*b* is an isometric view of a vibration isolating mounting clip according to an aspect of the invention.

Various aspects of the invention are presented in FIGS. 1-11*b* which are not drawn to scale and in which like components are numbered alike. Referring now to these figures, according to an aspect of the invention, a vibration isolating mounting clip 10 is used to mount a furring channel 20 to a mounting surface 30. The ceiling or other finishing substrate is then attached to the furring channel, thus loading the isolating clip. The furring channel 20 comprises a channel portion 22 and two opposing furring channel flanges 24/26. The vibration isolating clip 10 comprises resilient bent metal strip 40 having a first end 42 and an opposing second end 44, wherein the first end 42 is flat, and the second end 44 is shaped like the channel portion 22 of the furring channel 20, and sized such that the furring channel portion 22 fits in the bent metal strip second end 44. The resilient bent metal strip first end 42 is mounted to the mounting surface 30. The stiffness of the resilient bent metal strip 40 is such that when the furring channel 20 is positioned in the resilient bent metal strip second end 44, and the clip is loaded with the finishing substrate, the furring channel 20 does not contact the mounting surface 30, and the furring channel flanges 24/26 are relatively parallel to the mounting surface 30.

According to a further aspect of the invention, the furring channel 20 is further secured to the mounting clip 10 by an attachment mechanism 50, wherein the attachment mechanism 50 passes through the channel portion 22 of the furring channel 20, and the resilient bent metal strip second end 44, but does not contact the mounting surface 30.

According to another aspect of the invention, the vibration isolating mounting clip 10 comprises a resilient bent metal strip 40 having a first end 42 and a second end 44, wherein the first end 42 is adapted for mounting to the mounting surface 30. The resilient bent metal strip 40 further has a top side 47, and a bottom side 48, wherein the top side 47 faces the mounting surface 30 when mounted, and the bottom side 48 faces away from the mounting surface when mounted. The mounting clip 10 further comprises a first bracket 62 and an opposing second bracket 64, on the resilient bent metal strip second end 44, bottom side 48. The first bracket 62 and second bracket 64 are of a size and shape to fit the furring channel flanges 24/26, such that the furring channel flanges 24/26 may be slid into the first bracket 62 and second bracket 64, and as such are mounted to the resilient bent metal strip 40.

According to a further aspect of the invention, the furring channel 20 is further mounted to the mounting clip 10 by an attachment mechanism 50, which passes through the furring channel flanges 24/26, and through the first bracket 62 and the second bracket 64, but does not contact the mounting surface 30.

In the past, to vibrationally isolate a ceiling and/or wall from the mounting surface, a complex, multi-part clip was necessary to mount the furring channel, or, a furring channel wasn't used at all, but instead a resilient channel was used. The present clip and mounting method allows for use of a standard furring channel, with a 1 piece clip. The clip described above is a single clip, however, during use, several clips would be used along the length of the furring channel.

According to an aspect of the invention, the vibration isolating clip comprises a resilient bent metal strip having a length 45 and a width 46, wherein the width 46 is on the order of 2 inches. According to a further aspect of the invention, the width 46 is less than 3 inches. The width of the clip is not limited to these dimensions, as any reasonable dimension that will attach to a joist and allow for several clips per furring channel is contemplated by this invention. Thus, according to an aspect of the invention, if mounting the furring channel 20 to a series of joists 32, the furring channel 20 may be mounted perpendicular to the joists 32, wherein there is a single clip 10 per joist 32. The mounting clips 10 are then mounted to the joists 32 such that the cup shaped second ends 44 line up to allow the furring channel 20 to sit in numerous clips 10 simultaneously, such that the furring channel 20 is relatively perpendicular to the joists 32. According to a further aspect of the invention, if the mounting clip 10 has the first and second brackets (62/64) on the resilient bent metal strip second end 44, the brackets (62/64) should line up such that the furring channel 20 may sit in numerous clips 10 simultaneously. Of course, the clips 10 may also be positioned such that the furring channel 20 is mounted parallel to the joists 32.

According to another aspect of the invention, a vibration isolating mounting clip 10 for resiliently mounting a furring channel 20, or other substrate (such as, but not limited to, a ceiling grid for hanging a floating ceiling) to a mounting surface 30, is comprised of a resilient bent metal strip 70, which is attachable to the mounting surface 30 in two places. The strip 70 has two opposing end portions, a first end 72 and a second end 74, and a middle portion 73, wherein there is a transition portion 75 between the middle portion 73, and each of the end portions 72/74. The end portions 72/74 are adapted to be mounted to the mounting surface 30, and the middle portion 73 is shaped to the contours of the channel portion of the furring channel 22. The resiliency of the resilient bent metal strip 70, and the shape of the transition portions 75 are such that when the clip 10 is mounted to the mounting surface 30, and a furring channel 20 (or other substrate) is placed in the middle portion 73, and the clip is further loaded via the furring channel) with the finishing substrate, no part of the furring channel 20 (or other substrate) is in contact with the mounting surface 30, and the flanges 22/24 of the furring channel are relatively parallel to the mounting surface 30.

The clip is meant to be small, relative to the size of the furring channel (or other substrate), and therefore the width 76 of the bent metal strip 70 is on the order of 2 inches, but in the preferred embodiment, not greater than 3 inches. The width of the clip is not limited to these dimensions, as any reasonable dimension that will attach to a joist and allow for several clips per furring channel is contemplated by this invention According to another aspect of the invention, the furring channel 20 (or other substrate) is further secured to the mounting clip 10 by mounting to said resilient bent metal strip 70 middle portion 73 via a mounting mechanism 50.

In a further embodiment of the invention, the transition portions 75 have multiple bends, such that when mounted on the mounting surface 30, these bends 78 bend the strip 70 away from the mounting surface 30 at least once, and towards the mounting surface 30 at least once. In a further embodiment, these bends 78 bend towards the mounting surface 30, and away from the mounting surface 30 multiple times (see FIG. 11A).

According to a further embodiment portions of the clip 10 are coated with a elastomeric or a viscoelastic coating 130, such as, but not limited to, plastisol, or other vinyl or rubber coating or dip. (see FIG. 11*b*)

According to another aspect of the invention, elastomeric or a viscoelastic material may be placed in transitional portions 75 to further damp vibration According to a further embodiment of the invention, a resilient bent metal strip 80, has two opposing end portions, a first end 82 and a second end 84, and a middle portion 83. The middle portion 83 is adapted to be mounted to the mounting surface 30, and the end portions 82/84 bend away from the mounting surface 30, and bend back towards the middle portion 83. The opposing ends 82/84 are facing each other, wherein there is a gap 85 between them. The gap 85 is sized such that a furring channel 20 may be placed between the ends 82/84, and the furring channel flanges 24/26 would rest on the ends 82/84, and be supported thereby.

According to a further aspect of the invention, a vibration isolating mounting clip comprises a resilient bent metal strip 90, wherein the strip 90 has two opposing end portions, a first end 92 and a second end 94, and a middle portion 93, wherein the first end 92 is adapted to be mounted to the mounting surface 30, and the second end 94 is adapted to be mounted to the furring channel 20. In a preferred embodiment, this second end is adapted to be mounted to the furring channel via a wire tie, thus there is a hole for attaching the wire tie. According to a further embodiment, the vibration isolating mounting clip further comprises a second resilient bent metal strip 100, wherein the second resilient bent metal strip 100 also has two opposing end portions, a first end 102 and a second end 104, and a middle portion 103, wherein the first end 102 is adapted to be mounted to the mounting surface 30, and the second end 104 is adapted to be mounted to the furring channel 20, and further wherein the resilient strips 90/100 mirror each other. In this embodiment, the first ends 92/102 are in contact with each other, and the second ends 94/104 are in contact with each other. In a further embodiment, the first end 92 and second end 94 are in a common plane. When there are two bent strips together, the first end 102 is also in a common plane with the second end 104.

In a further embodiment of the invention, the vibration isolating mounting clip 10 comprises a resilient bent metal strip 110, wherein the strip 110 has two opposing end portions, a first end 112 and a second end 114, and a middle portion 113, wherein there is a transition portion 115 between the middle portion 113, and each of the end portions 112/114. The end portions 112/114 are adapted to be mounted to the mounting surface 30, and wherein the middle portion 113 is adapted to be mounted to the furring channel 20 (or other substrate). In a preferred embodiment, this second end is adapted to be mounted to the furring channel (or other substrate) via a wire tie, thus there is a hole for attaching the wire tie. According to an aspect of the invention, the transition portions 115 have multiple bends 118, such that when mounted on the mounting surface 30, these bends 118 bend the strip 110 away from the mounting surface 30 at least once, and towards the mounting surface 30 at least once. In a further embodiment, the bends 118 bend towards the mounting surface 30, and away from the mounting surface 30 multiple times.

According to an aspect of the invention, a method for producing a vibration isolating mounting clip 10 for mounting a furring channel 20 (or other substrate, such as, but not limited to, a ceiling grid for hanging a floating ceiling) to a mounting surface 30, comprises the steps of cutting a metal strip 120 from a section of sheet metal 200, or metal coil 210; blanking out parts of the metal strip 120 for which bending is not desired; and, stamping the metal strip 120 into a bent shape 128. The sheet metal 200 or metal coil 210 should be thin enough to be resilient when cut to the desired length. The strip 120 should be stamped such that the strip 120 has two opposing end portions, a first end 122 and a second end 124, and a middle portion 123, wherein there is a transition portion 125 between the middle portion 123, and each of said end portions 122/124. The end portions 122/124 are not stamped, and the middle portion 123 is shaped to the contours of the channel portion of the furring channel 22. The resiliency of the bent metal strip 120, and the shape of the transition portions 125 are such that when the clip 10 is mounted to the mounting surface 30, and a furring channel 20 (or other substrate) is placed in the middle portion 123, and the clip is loaded to a finishing substrate, via the furring channel, no part of the furring channel 20 (or other substrate) is in contact with the mounting surface 30, and the flanges 24/26 of the furring channel 20 are relatively parallel to the mounting surface 30.

In a further embodiment of the invention, the opposing end portions 122/124 are adapted to be mounted to the mounting surface 30.

In a preferred embodiment of the invention, the stamped metal strip is heat-treated to get the desired material properties. The opposing ends 122/124 of the metal strip, which have been blanked out during the stamping, may further be shaped to any desired shape.

According to a further aspect of the invention, the stamping produces multiple bends 129 in the transition portion 125, such that when mounted on the mounting surface 30, these bends 129 bend the strip away from the mounting surface 30 at least once, and towards the mounting surface 30 at least once. In a further embodiment, these bends 129 bend towards the mounting surface 30, and away from the mounting surface 30 multiple times.

What is claimed is:

1. A vibration isolating mounting clip resiliently mounting a furring channel to a mounting surface, wherein the furring channel is further loaded with a finishing substrate, wherein the furring channel has a channel portion, and opposing flanges, comprising:

a resilient bent metal strip, wherein said strip has two opposing end portions, a first end and a second end, and a middle portion, wherein there is a transition portion between said middle portion, and each of said end portions, wherein said end portions are mounted to the mounting surface, and wherein said middle portion is shaped to the contours of the channel portion of the furring channel, wherein the resiliency of said resilient bent metal strip, and the shape of said transition portions are such that when said clip is mounted to the mounting surface, and a furring channel is placed in said middle portion, and the finishing substrate is mounted to the furring channel, no part of the furring channel is in contact with the mounting surface, and the flanges of the furring channel are relatively parallel to the mounting surface, wherein said transition portions have multiple bends, such that when mounted on the mounting surface, these bends bend said strip away from the mounting surface at least once, and towards the mounting surface at least once.

2. The vibration isolating mounting clip of claim 1 wherein said bends bend towards the mounting surface, and away from the mounting surface multiple times.

3. The vibration isolating clip of claim 1 wherein when said clip is mounted to said mounting surface portions of said clip which are coated with an elastomeric coating.

4. The vibration isolating clip of claim 1 wherein when said clip is mounted to said mounting surface portions of said clip which are coated with an viscoelastic coating.

5. The vibration isolating clip of claim 3 wherein said elastomeric coating is a plastisol dip.

6. A vibration isolating mounting clip resiliently mounting a furring channel to a mounting surface, comprising:

a resilient bent metal strip, wherein said strip has two opposing end portions, a first end and a second end, and a middle portion, wherein there is a transition portion between said middle portion, and each of said end portions, wherein said end portions are mounted to the mounting surface, and wherein said middle portion receives the furring channel, wherein said transition portions have multiple bends, such that when mounted on the mounting surface, these bends bend said strip away from the mounting surface at least once, and towards the mounting surface at least once.

7. The vibration isolating mounting clip of claim 6 wherein said bends bend towards the mounting surface, and away from the mounting surface multiple times.

* * * * *